US006604403B1

(12) United States Patent
Eslambolchi et al.

(10) Patent No.: US 6,604,403 B1
(45) Date of Patent: Aug. 12, 2003

(54) POCKET CRIMPER FOR FIBER OPTIC CABLES

(75) Inventors: Hossein Eslambolchi, Los Altos Hills, CA (US); John Sinclair Huffman, Conyers, GA (US); James F. Kirkpatrick, Conyers, GA (US)

(73) Assignee: AT&T Corp., New York, NY (US)

( * ) Notice: Subject to any disclaimer, the term of this patent is extended or adjusted under 35 U.S.C. 154(b) by 11 days.

(21) Appl. No.: 10/002,738

(22) Filed: Nov. 2, 2001

(51) Int. Cl.[7] ..... H01R 43/042

(52) U.S. Cl. ..... 72/416; 72/412; 29/751; 29/282; 29/283.5

(58) Field of Search ..... 72/416, 412, 407, 72/402; 29/751, 753, 283.5, 282, 234, 275, 237, 254

(56) References Cited

U.S. PATENT DOCUMENTS 2,182,663 A * 12/1939 Eby ..... 29/517
2,901,003 A * 8/1959 Rosner ..... 72/407
3,163,200 A * 12/1964 Brosky ..... 72/412
3,221,532 A * 12/1965 Bazata ..... 72/312
3,577,622 A * 5/1971 Shaffer ..... 29/751
4,891,877 A * 1/1990 Talavera ..... 29/237
4,986,106 A 1/1991 Gwo-Jiang
5,625,942 A * 5/1997 Casey ..... 29/751
6,138,346 A 10/2000 Shutts et al.

* cited by examiner

*Primary Examiner*—Daniel C. Crane

(57) ABSTRACT

A crimper tool for use in attaching lugs to the metallic sheath covering on fiber optic cables includes a pair of blocks, with a trough formed in each block to accommodate the cable when one block is placed on top of the other. Each block includes at least one slot for positioning a proper-sized die to perform the crimping action. The use of this block crimper tool is particularly advantageous when a hand-held crimper is too small to accommodate a large diameter fiber cable.

8 Claims, 4 Drawing Sheets

POCKET CRIMPER FOR FIBER OPTIC CABLES

TECHNICAL FIELD

The present invention relates to a pocket crimper for making an electrical connection to the metallic jacket layer of fiber optic cable and, more particularly, to a crimper tool that may be used with cables of any size, as well as in situations where a hand-held crimper cannot be used.

BACKGROUND OF THE INVENTION

In the electronics industry there are many hand-held tools that must be utilized during the installation of fiber optic facilities. One of these tools is a hand-held crimper, This tool is used for making electrical connections between the metallic outer sheath layers of two separate pieces of fiber optic cable. The process as performed in the prior art involves using a specific type and size of crimping tool for each size of cable. Each cable first needs to be prepared by removing its outer poly (plastic;) coating to expose the underlying metallic sheath layer in the cable. Lugs are then fitted onto the ends of the cables and placed in the crimping tool. Each size of cable will require a specific die and specific lug to be placed into the crimping tool for securing the connection.

In most cases, the connection of the lug to the cable is made by using a hand-held crimping tool, where an individual applies pressure to a pair of handles to tighten the lugs onto the ends of the cable. This process works well in most cases, but there are situations that require a different approach to the crimping process. For example, some cables have an extremely large diameter (for example, up to 1" in diameter), and a hand-held crimper is simply too small to effectively make a good crimped connection between the lug and the metallic sheath layer. In other situations, a hand-crimper lacks sufficient strength and a power-assisted crimper tool is too costly. There may be other situations where the use of a different approach than a hand-held crimper tool may be preferred.

SUMMARY OF THE INVENTION

The present invention relates to a pocket crimper for making an electrical connection to the metallic jacket layer of fiber optic cable and, more particularly, to a crimper tool that may be used with cables of any size, as well as in situations where a hand-held crimper cannot be used.

A pocket crimper of the present invention comprises a pair of relatively small rectangular or cube shaped blocks formed of a relatively strong material, such as heavy duty forged steel. Each block comprises a longitudinal trough for holding the fiber optic cable as it is being crimped, the troughs mating when one block is placed on top of the other. Each block also comprises a number of slots for holding various size dies that may be used for the crimping process. In particular, the crimping operation is performed by first placing the appropriate sized bottom die in the lower block. A lug is then inserted on the end of the stripped cable (exposing the metallic sheath layer) and the cable with the lug is laid on the trough so that the lug is positioned over the bottom die. The top block is then put in place over the bottom block (the trough in the top block allowing the cable to be enclosed without moving) and the appropriate sized die is inserted in the top block. A small hammer, or other similar object, is then used to strike the top die, which will then move downward and crimp the lug onto the metallic sheath of the fiber cable.

It is an aspect of the present invention that the trough in the blocks is sized to accommodate the various diameters of fiber optic cable that are deployed in the field. Thus, extremely large diameter cables that have heretofore been difficult to crimp with a hand-held device can easily be laid within the pocket crimper of the present invention and the associated lug attached to the cable. By including a plurality of different slots in each block of the crimper, dies of different sizes can easily be used.

Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
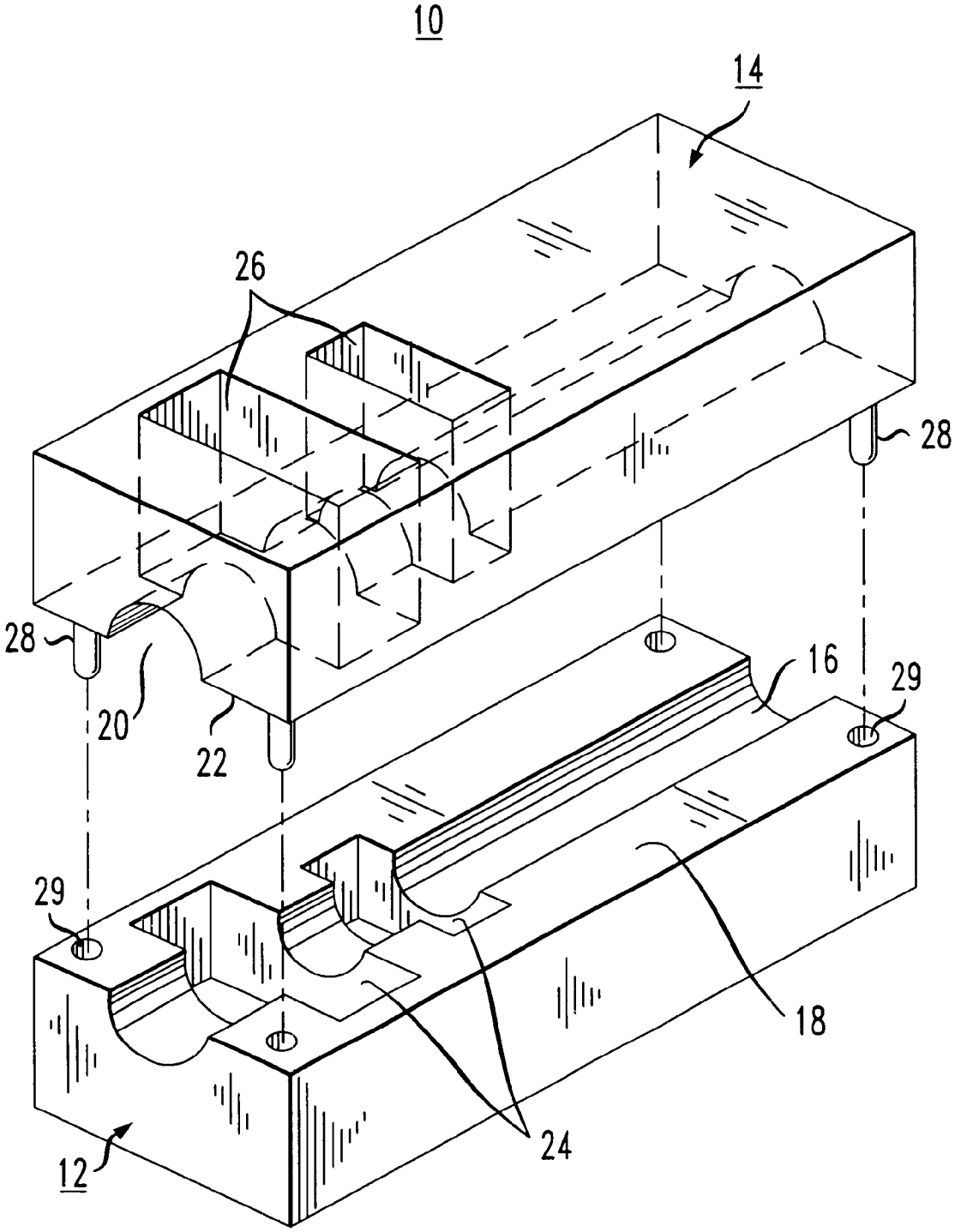
FIG. 1 illustrates, in an exploded isometric view, an exemplary pocket crimper formed in accordance with the present invention.

FIG. 1 illustrates an exemplary pocket crimper 10 of the present invention, which comprises a bottom block 12 and a top block 14, both blocks formed of a mechanically strong material, such as heavy duty forged steel. Bottom block 12 includes a longitudinal trough 16 formed in top surface 18, where trough 16 extends along the entire length of bottom block 12. A similar trough 20 is formed along bottom surface 22 of top block 14, as shown in phantom in FIG. 1. The troughs are formed of a sufficient diameter and depth such that when top block 14 is mated with bottom block 12, the troughs will align and accommodate fiber optic cables of varying sizes.

A plurality of die slots 24 are formed in top surface 18 of bottom block 12, where each slot has a slightly different width and is thus able to accommodate many different dies that can be used to perform the crimping operation. Although only two such die slots 24 are shown in FIG. 1, it is to be understood that a pocket crimper of the present invention may include many more die slots. A similar plurality of die slots 26 are formed through top block 12, where the plurality of die slots 26 will align with die slots 24 when top block 14 is placed over bottom block 12. In one embodiment, a set of locating pins 28 (in this example, formed on bottom surface 22 of top block 14) and locating holes 29 (in this example, formed on top surface 18 of bottom block 12) may be used to efficiently align top block 14 with bottom block 12.

Figure 2:
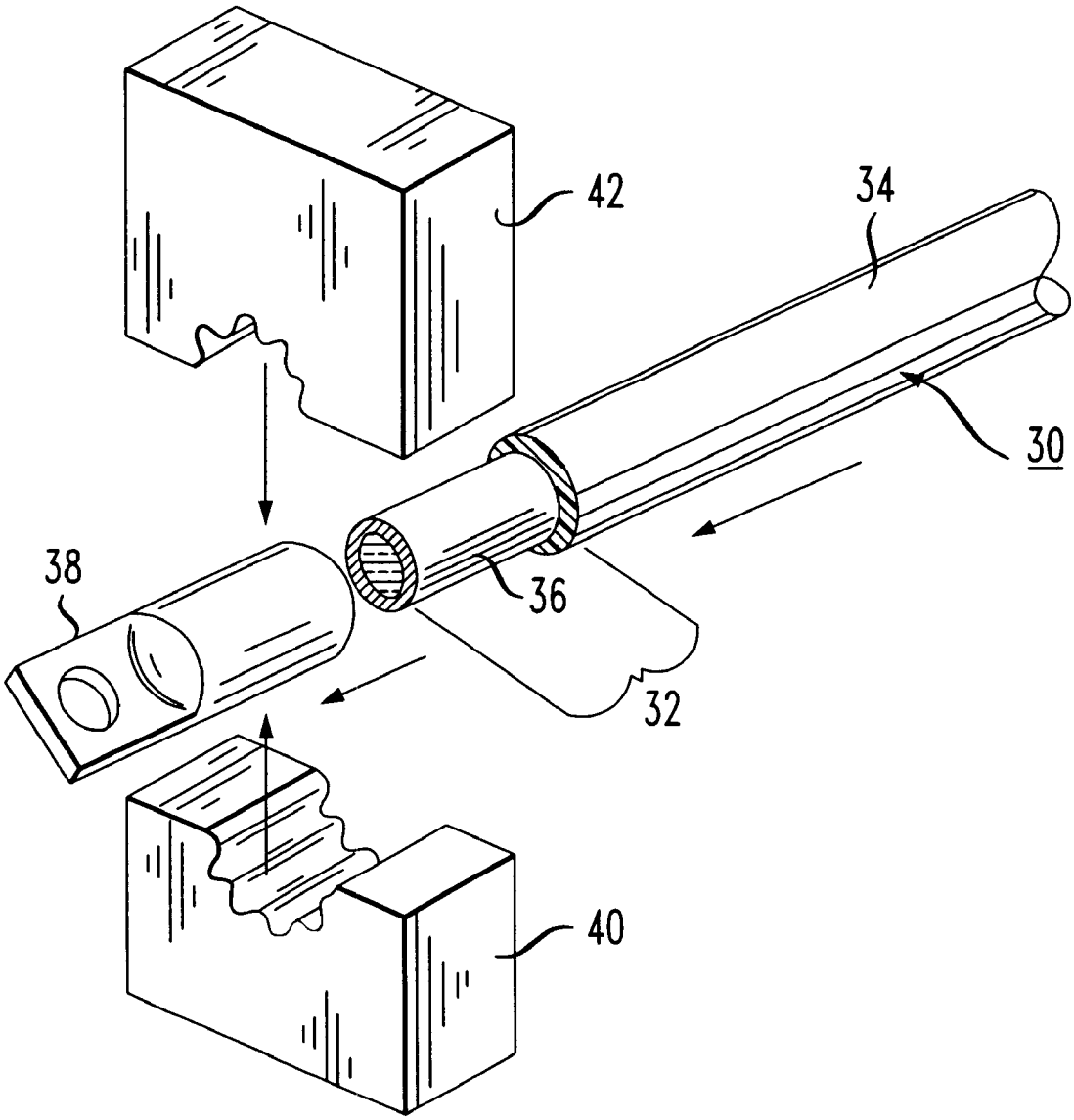
FIG. 2 shows a conventional fiber optic cable, with a portion of the outer poly coating layer removed and a lug attached to the end of the cable to connect to the metallic sheath layer, as well as a pair of dies that are used to perform the crimping action.
Figure 3:
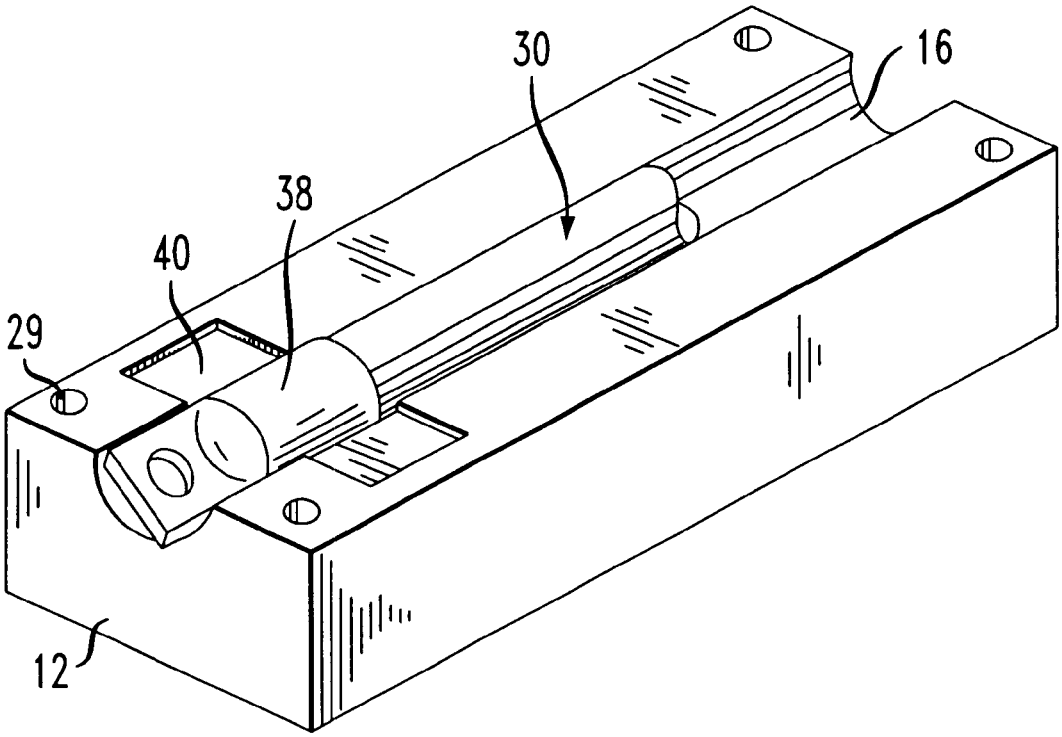
FIG. 3 illustrates the fiber and lug of FIG. 2 as positioned in the bottom half of a pocket crimper formed in accordance with the present invention.
Figure 4:
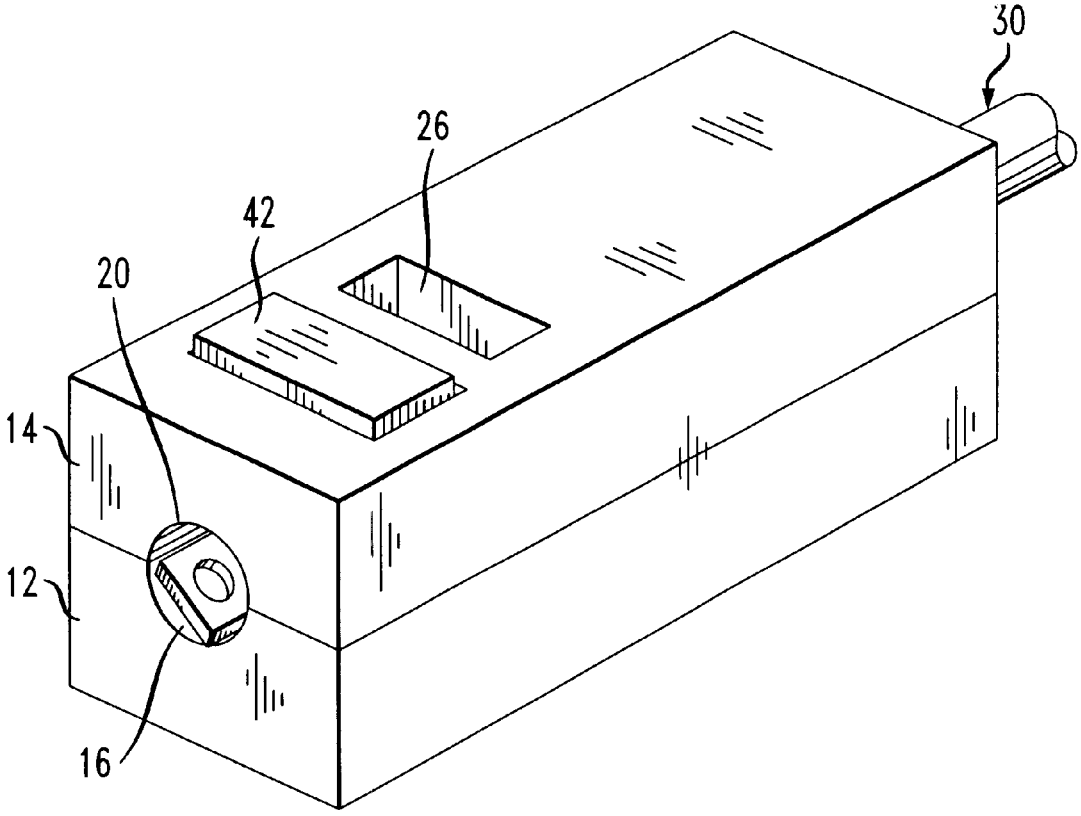
FIG. 4 illustrates an exemplary pocket crimper with the top block in place over the cable, illustrating the application of force to crimp the lug onto the metallic sheath of the cable.

FIG. 2 illustrates an exemplary section of fiber optic cable 30, where end portion 32 of cable 30 has been stripped of outer poly covering layer 34 to expose metallic sheath layer 36. A lug 38 is illustrated as positioned over end portion 32 of cable 30. In order to form a strong mechanical and electrical fit of lug 38 over metallic sheath layer 36, lug 38 is "crimped", or squeezed around metallic sheath layer 36, using a pair of dies 40, 42 to force lug 38 onto cable 30 as shown in FIG. 2. In using the tool of the present invention, lug 38 is first inserted on cable end portion 32, then cable 30 is laid in trough 16 of bottom block 12, as shown in FIG. 3. Prior to positioning cable 30 in trough 16, the proper size die 40 is inserted in die slot 24 of bottom block 12. The corresponding die 42 is inserted in top block 14, which is then mated with bottom block 12. The final arrangement of the lug and cable in pocket crimper 10 is shown in FIG. 4. In order to perform the crimping action, a hammer or other tool is used to strike die 42 with a force sufficient to move die 42 into top block 14, which will in turn force lug 38 to engage metallic sheath layer 36 of cable 30.

What is claimed is:

1. A crimper tool for attaching a lug element to an exposed metallic sheath layer of a fiber optic cable, said crimper tool comprising a bottom block including a longitudinal trough formed in the top surface thereof, said bottom block further comprising at least one die slot for accommodating at least one crimping die;

a top block including a longitudinal trough formed in the bottom surface thereof such that when the top block is mated with the bottom block the troughs align and form an area for placing a fiber optic cable to be crimped, said top block further comprising at least one die slot for accommodating at least one crimping die, said at least one top block die slot aligning with the at least one bottom block die slot when said top block is mated with said bottom block; and at least one pair of crimping dies to be inserted in a pair of aligned die slots, wherein a die of said at least one pair may be struck to attach a lug element onto an exposed metallic sheath layer of a fiber optic cable disposed in the aligned troughs.

2. A crimper tool as defined in claim 1 wherein the bottom block top surface and the top block bottom surface further comprise alignment guides to aid in the mating of said top block to said bottom block.

3. A crimper tool as defined in claim 1 wherein the bottom block top surface comprises at least one alignment hole and the top block bottom surface comprises at least one alignment pin for mating with the alignment hole upon attachment of the top block to the bottom block.

4. A crimper tool as defined in claim 1 wherein the bottom block top surface includes a plurality of alignment holes and wherein the top block bottom surface includes a plurality of alignment pins.

5. A crimper tool as defined in claim 1 wherein the at least one bottom block top surface includes a plurality of die slots and the at least one top block bottom surface includes a plurality of die slots, and further includes a plurality of different sized crimping dies.

6. A crimper tool as defined in claim 1 wherein the top block and the bottom block comprise heavy duty forged steel.

7. A crimper tool as defined in claim 6 wherein the at least one pair of dies comprises heavy duty forged steel.

8. A method of crimping an electrical connection lug onto a section of fiber optic cable, the method comprising the steps of:

a) stripping a fiber optic cable to expose a metallic sheath layer;

b) inserting a lug of appropriate size over the exposed section of fiber optic cable;

c) providing a pocket crimping tool comprising a bottom block including a longitudinal trough formed in the top surface thereof for accommodating the exposed section of fiber optic cable, said bottom block further comprising at least one die slot for accommodating at least one crimping die and a top block including a longitudinal trough formed in the bottom surface thereof such that when the top block is mated with the bottom block the troughs align and accommodate said fiber optic cable and inserted lug, said top block further comprising at least one die slot for accommodating at least one crimping die, said at least one top block die slot aligning with the at least one bottom block die slot when said top block is mated with said bottom block;

d) inserting appropriate-sized dies in the bottom and top block die slots; and e) striking a die with a force sufficient to crimp the lug into position around the exposed section of fiber optic cable.

* * * * *